US007075484B2

(12) United States Patent
Sung

(10) Patent No.: US 7,075,484 B2
(45) Date of Patent: Jul. 11, 2006

(54) INTERNAL ANTENNA OF MOBILE COMMUNICATION TERMINAL

(75) Inventor: Jae Suk Sung, Suwon (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 139 days.

(21) Appl. No.: 10/690,595

(22) Filed: Oct. 23, 2003

(65) Prior Publication Data

US 2004/0263396 A1 Dec. 30, 2004

(30) Foreign Application Priority Data

Jun. 25, 2003 (KR) ..... 10-2003-41663
Sep. 4, 2003 (KR) ..... 10-2003-61830

(51) Int. Cl.
*H01Q 1/26* (2006.01)

(52) U.S. Cl. ..... 343/700 MS
(58) Field of Classification Search ..... 343/702, 343/746, 700 MS, 867, 853, 795
See application file for complete search history.

(56) References Cited

U.S. PATENT DOCUMENTS 6,236,368 B1 5/2001 Johson ..... 343/702
6,392,610 B1 * 5/2002 Braun et al. ..... 343/876
2002/0130816 A1 9/2002 Boyle ..... 343/702
2002/0135521 A1 * 9/2002 Moore ..... 343/702
2002/0137476 A1 * 9/2002 Shin ..... 455/90
2003/0016178 A1 * 1/2003 Byun et al. ..... 343/702

FOREIGN PATENT DOCUMENTS

| | | |
|---|---|---|
| EP | 0829917 | 3/1998 |
| EP | 1120855 | 8/2001 |
| JP | 200031724 | 1/2000 |
| JP | 2000269724 | 9/2000 |

OTHER PUBLICATIONS

Boyle, K. R. *Differentially slotted and differentially filled PIFAs*. Electronic Letters, Jan. 9, 2003, vol. 39, No.1, pp. 9–10.

* cited by examiner

*Primary Examiner*—Don Wong
*Assistant Examiner*—Minh Dieu A
(74) *Attorney, Agent, or Firm*—Lowe Hauptman & Berner, LLP

(57) ABSTRACT

Antenna for use in a mobile communication terminal includes a power feed unit for feeding power to the antenna, a ground unit for grounding the antenna, and a radiation unit formed in a band shape with a designated width. The radiation unit has one end connected to the power feed unit and the other end connected to the ground unit, is arranged along an edge of an upper surface of a dielectric support unit for supporting the antenna so as to form a loop-shaped current path, and radiates at a designated low frequency band when a current is introduced to the power feed unit.

21 Claims, 12 Drawing Sheets

INTERNAL ANTENNA OF MOBILE COMMUNICATION TERMINAL

BACKGROUND OF THE INVENTION

1. Field of the Invention

The present invention relates to an antenna for a mobile communication terminal, and more particularly to an antenna installed in a mobile communication terminal for processing transmitted/received signals.

2. Description of the Related Art

Recently, mobile communication terminals have been developed so as to satisfy a miniaturization and light-weight trend and provide various services. In order to meet these requirements, internal circuits and components employed in the mobile communication terminal have been developed to have multiple functions and be miniaturized. Such a tendency is also applied to an antenna, which is one of the essential components of the mobile communication terminal.

A helical antenna and a planar inverted F-type antenna (hereinafter, referred to as "PIFA") are generally used in mobile communication terminals. The helical antenna is an external antenna fixed to the upper end of the terminal, and is used together with a monopole antenna. When an antenna assembly including the helical antenna and the monopole antenna is extended from a main body of the terminal, the antenna assembly serves as the monopole antenna, and when the antenna assembly is retracted into the main body of the terminal, the antenna assembly serves as a $\lambda/4$ helical antenna.

Such a combined structure of the helical antenna and the monopole antenna has an advantage such as a high gain. However, this combined structure of the helical antenna and the monopole antenna has a high SAR characteristic due to its non-directivity. Herein, the SAR characteristic is an index of the harmfulness of an electromagnetic wave to the human body. Since the helical antenna is protruded from the mobile communication terminal, it is difficult to aesthetically and portably design the appearance of the helical antenna. Further, the monopole antenna requires a sufficient storage space within the terminal. Therefore, the combined structure of the helical antenna and the monopole antenna limits the miniaturization of a mobile communication terminal product using this structure.

In order to solve the above problems, there has been proposed a PIFA having a low profile structure. FIG. 1 illustrates a structure of a conventional PIFA. The PIFA comprises a radiation unit 2, a short-circuit pin 4, a coaxial cable 5, and a ground plate 9. Power is fed to the radiation unit 2 through the coaxial cable 5, and the radiation unit 2 is short-circuited to the ground plate 9 through the short-circuit pin 4, thereby achieving impedance matching. The PIFA must be designed in consideration of the length (L) of the radiation unit 2 and the height (H) of the antenna based on the width ($W_p$) of the short-circuit pin 4 and the width (W) of the radiation unit 2.

In this PIFA, among beams generated by the induced current to the radiation unit 2, beams directed toward a ground plane are re-induced, thereby reducing the beams directed toward the human body and improving the SAR characteristic. Further, the beams induced toward the radiation unit 2 are increased. This PIFA functions as a square-shaped micro-strip antenna with the length of the radiation unit 2 reduced to half, achieving a low profile structure.

Further the PIFA is an internal antenna installed in the mobile communication terminal, thereby being aesthetically designed and protected from external impact.

In order to satisfy the trend of multi-functionality, the PIFA has been variously modified. Particularly, a dual band chip antenna, which is operable at different frequency bands, has been developed.

FIG. 2*a* is a schematic view of a conventional internal F-type dual band antenna.

With reference to FIG. 2*a*, the conventional F-type dual band chip antenna 10 comprises a radiation unit 20, a power feed pin 25, and a ground pin 26. The radiation unit 20 of the conventional F-type dual band chip antenna includes a high-band radiation unit 21 for processing a signal at a high band, which is located at the central area, and low-band radiation units 22, 23 and 24 for processing a signal at a low band, which are spaced from the high-band radiation unit 21 by a designated distance along the outer side of the high-band radiation unit 21. That is, the low-band radiation units 22, 23 and 24 are connected to the high-band radiation unit 21 in parallel. The power feed pin 25 and the ground pin 26 are connected to one end of the radiation unit 20.

FIG. 2*b* is a schematic view illustrating a current path in the conventional internal F-type dual band antenna.

As shown in FIG. 2*b*, currents 27 and 28 are respectively introduced into the high-band radiation unit 21 and the low-band radiation units 22, 23 and 24 through the power feed pin 25. The high-band radiation unit 21 radiates a radio wave of a high frequency signal by means of the current 27 introduced into the high-band radiation unit 21. Further, the low-band radiation units 22, 23 and 24 radiate radio waves of low frequency signals by means of the current 28 introduced into the low-band radiation units 22, 23 and 24.

The above conventional internal F-type dual band antenna is generally employed in a bar-type terminal having a large space for the antenna. However, the conventional F-type antenna has a large size, thus requiring a comparatively large storage space in the terminal. Further, in case that the conventional F-type antenna is manufactured in a small size, a usable frequency band of the antenna is narrowed and the antenna is negatively influenced by external stresses, i.e., the deterioration of the gain of the antenna. Particularly, in case that the above internal F-type dual band antenna is employed in a folder type terminal having a small size, the antenna is easily influenced by the human body, i.e., a position of a user's hand gripping the terminal. In this case, mute is generated during terminal communication, thereby preventing conversation via the terminal.

SUMMARY OF THE INVENTION

Therefore, the present invention has been made in view of the above problems, and it is an object of the present invention to provide an internal multi-band antenna for reducing distortion and deterioration in antenna characteristics due to influence of a user's body.

It is another object of the present invention to provide an internal multi-band antenna, which reduces the influence of a user's body and a position of a folder in a folder type mobile communication terminal, thereby being remarkably improved in terms of communicating performance.

It is yet another object of the present invention to provide a small-sized internal multi-band antenna, which reduces a size of a mobile communication terminal and improves an aesthetic appearance of the mobile communication terminal.

In accordance with the present invention, the above and other objects can be accomplished by the provision of an internal antenna for a mobile communication terminal comprising: a power feed unit for feeding power to the antenna; a ground unit for grounding the antenna; and a first radiation unit formed in a band shape having a designated width, including one end connected to the power feed unit and the other end connected to the ground unit, arranged along an edge of an upper surface of a dielectric support unit for supporting the antenna so as to form a loop-shaped current path, and serving to achieve radiation at a designated low frequency band using a current introduced through the power feed unit.

Preferably, the power feed unit or the ground unit may be arranged at an end of one surface of the dielectric support unit for supporting the antenna.

Preferably, the internal antenna may further comprise a second radiation unit formed in a band shape having a designated width, connected to an inner side of the left radiation unit of the first radiation unit, arranged on an upper surface of the dielectric support unit for supporting the antenna, and serving to achieve radiation at a designated high frequency band using current introduced through the power feed unit.

Further, preferably, the internal antenna may further comprise a third radiation unit formed in a band shape having a designated width, connected to an outer side of the left radiation unit of the first radiation unit, arranged on a left side or lower surface of the dielectric support unit for supporting the antenna, and serving to achieve radiation at a designated high frequency band using current introduced through the power feed unit.

Moreover, preferably, the internal antenna may further comprise a frequency adjustment unit formed in a band shape having a designated width, connected to an outer side of the first radiation unit in parallel, and serving to adjust a frequency to be processed by the antenna so as to control impedance matching.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
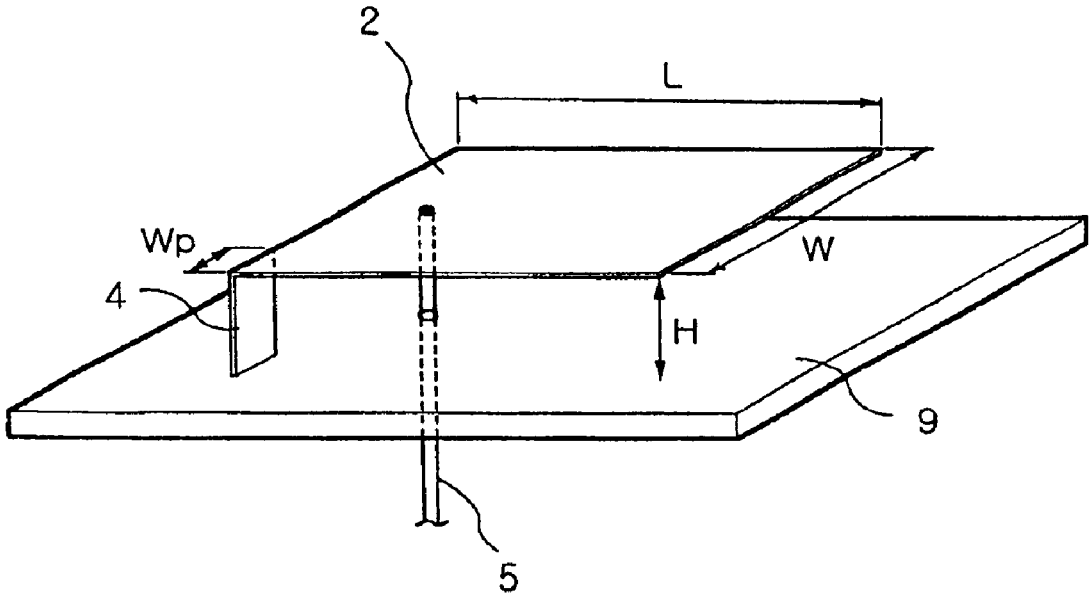
FIG. 1 PRIOR ART
FIG. 1 is a schematic view of a conventional planar inverted F-type antenna (PIFA)
Figure 2A:
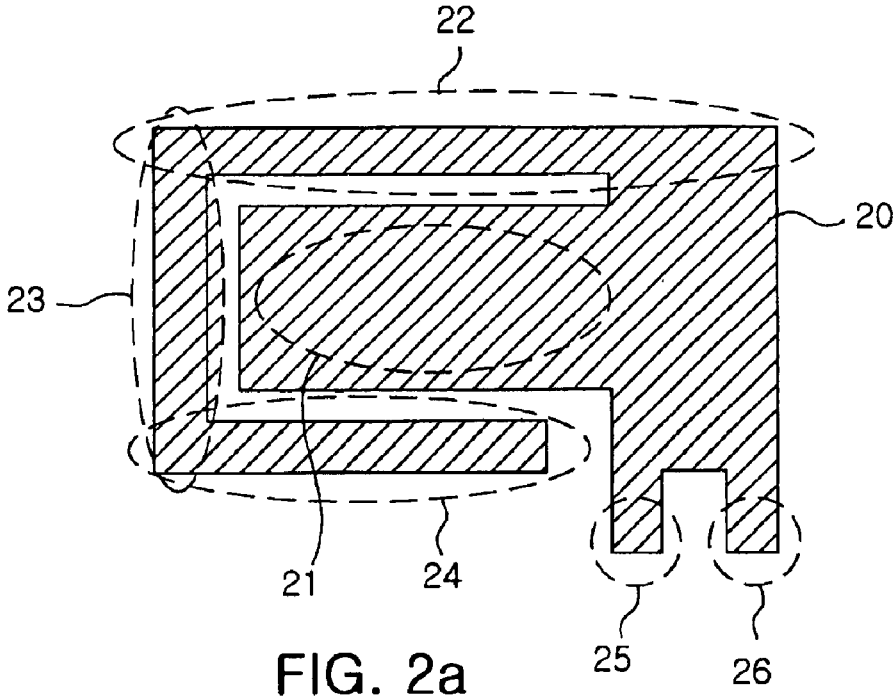
FIG. 2a PRIOR ART
FIG. 2*a* is a schematic view of a conventional internal dual band antenna.
Figure 2B:
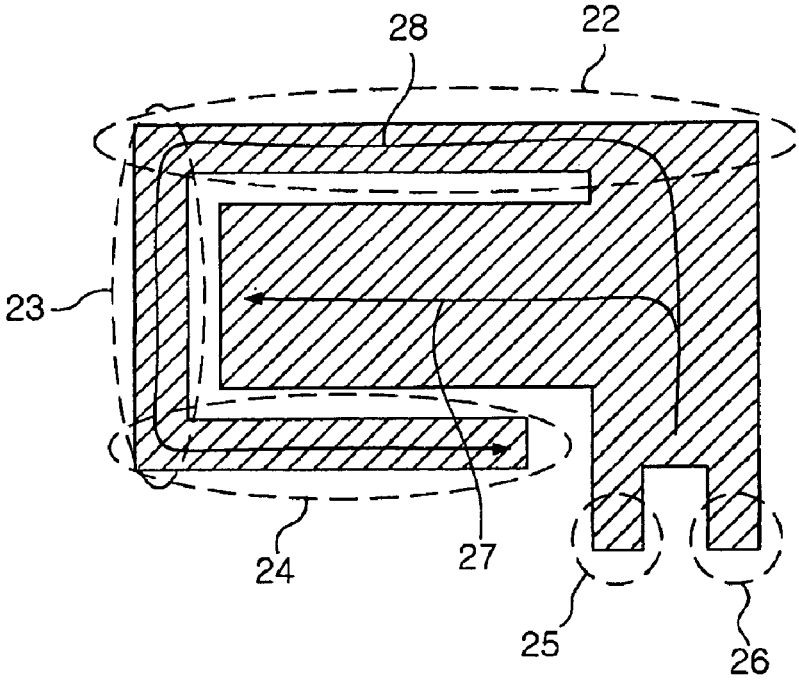
FIG. 2b PRIOR ART
FIG. 2*b* is a schematic view illustrating a current path in the conventional internal dual band antenna.

Now, preferred embodiments of the present invention will be described in detail with reference to the annexed drawings. In the drawings, the same or similar elements are denoted by the same reference numerals even though they are depicted in different drawings. In the following description of the present invention, a detailed description of known functions and configurations incorporated herein will be omitted when it may make the subject matter of the present invention rather unclear.

Figure 3:
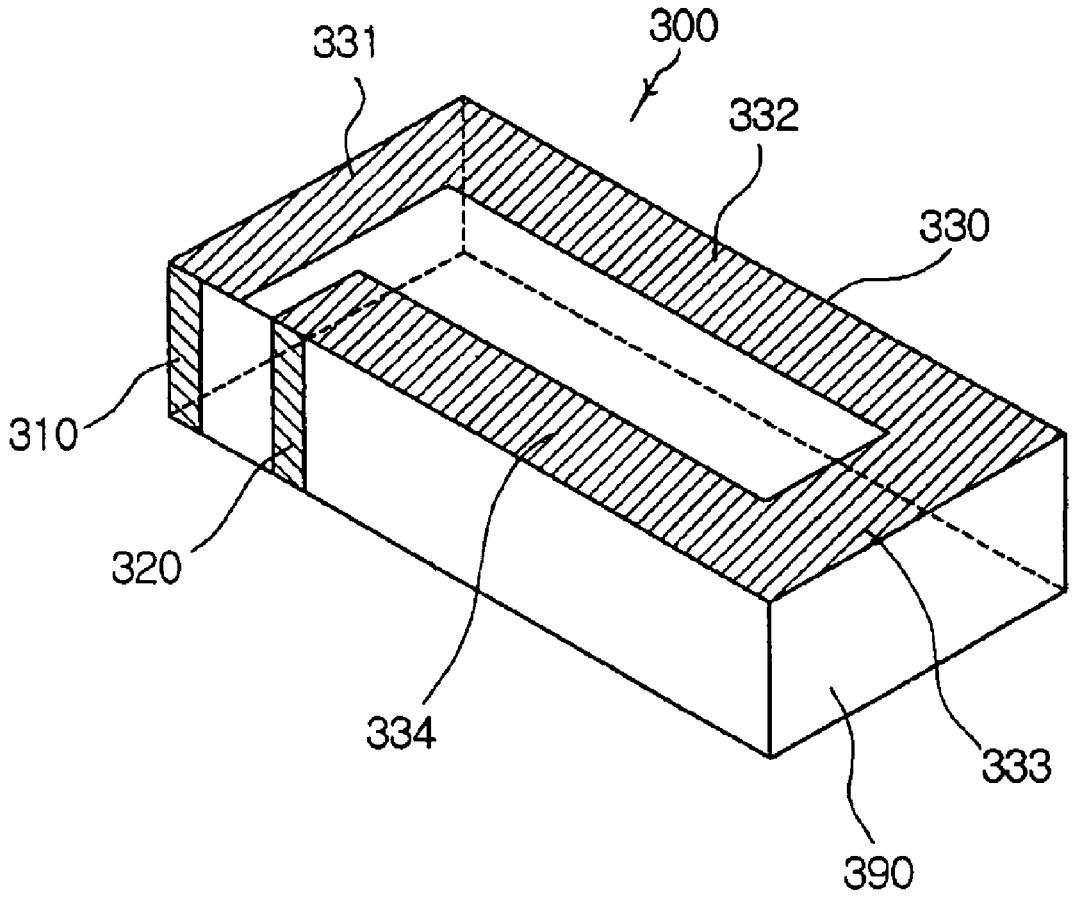
FIG. 3 is a perspective view of an internal antenna in accordance with a first embodiment of the present invention.

FIG. 3 is a perspective view of an internal antenna 300 in accordance with a first embodiment of the present invention.

With reference to FIG. 3, the internal antenna 300 in accordance with the first embodiment of the present invention comprises a power feed unit 310, a ground unit 320, and a first radiation unit 330. The antenna 300 is supported by a support unit 390, which is made of a dielectric material and has an approximately hexahedral shape.

The power feed unit 310 serves to supply power to the internal antenna 300. The ground unit 320 serves to ground the internal antenna 300. One end of the first radiation unit 330 is connected to the power feed unit 310 and the other end of the first radiation unit 330 is connected to the ground unit 320, so that the first radiation unit 330 has a loop-shaped structure. The above-described power feed unit 310, first radiation unit 330 and ground unit 320 form an electrical circuit. As shown in FIG. 3, a current path obtained by the first radiation unit 330 has a long loop shape, and serves to perform radiation at a low frequency band. Here, the power feed unit 310 is located close to one edge of the front surface of the dielectric support unit 390, and preferably on one end of the front surface of the dielectric support unit 390. The ground unit 320 is located on the front surface of the dielectric support unit 390 so that the ground unit 320 is separated from the power feed unit 310 by a designated distance, thereby allowing the antenna 300 to be grounded. The first radiation unit 330 is formed in a band shape having a designated width, and arranged along the edge of the upper surface of the support unit 390. One end of the first radiation unit 330 is connected to the power feed unit 310, and the other end of the first radiation unit 330 is connected to the ground unit 320. The first radiation unit 330 is divided into a left radiation unit 331, an upper radiation unit 332, a right radiation unit 333 and a lower radiation unit 334 according to their positions arranged on the support unit 390. Those skilled in the art will appreciate that the width of the first radiation unit 330 may be slightly changed along the loop-shaped path. Further, those skilled in the art will appreciate that the positions of the power feed unit 310 and the ground unit 320 may be slightly changed.

Figure 4:
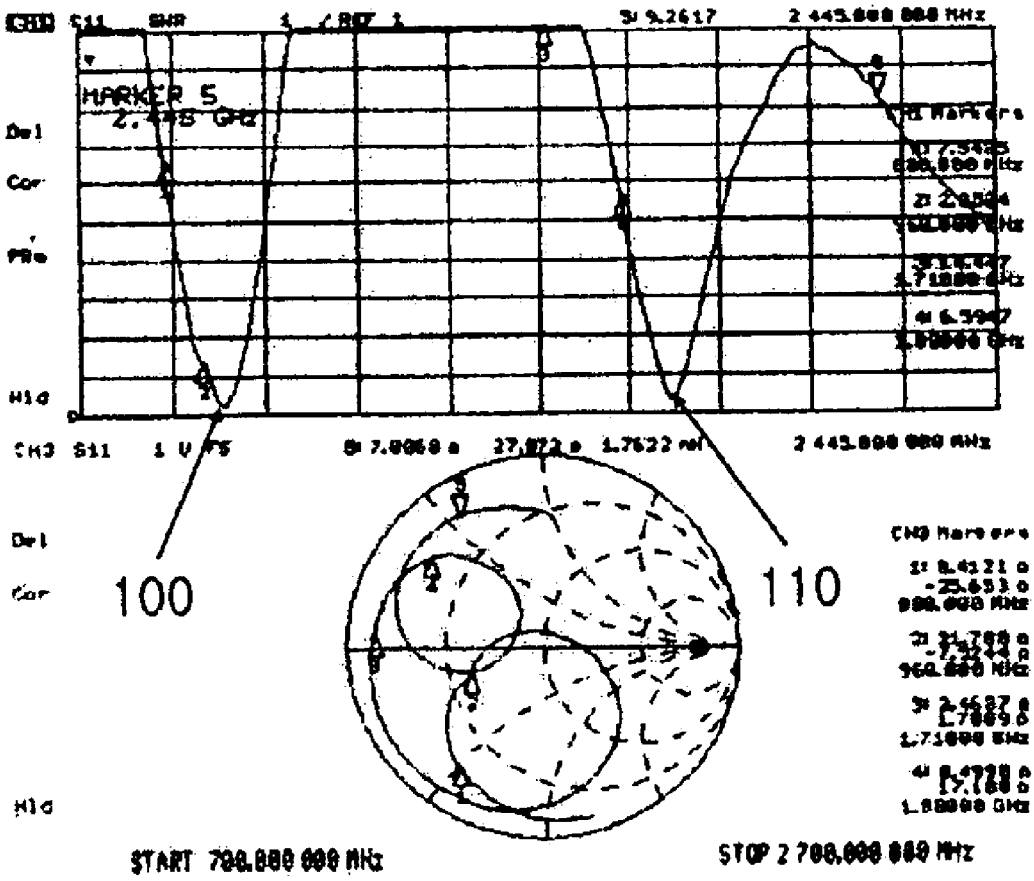
FIG. 4 is a graph illustrating a voltage standing wave ration (VSWR) of the internal antenna in accordance with the first embodiment of the present invention.

FIG. 4 is a graph illustrating a voltage standing wave ratio (VSWR) of the internal antenna 300 in accordance with the first embodiment of the present invention.

In the graph of FIG. 4, a horizontal axis represents frequency, and a vertical axis represents a VSWR. With reference to FIG. 4, the first radiation unit 330 of the internal antenna 300 in accordance with the first embodiment of the present invention is resonated at a low frequency band (900 MHz) shown by reference numeral 100, thereby exhibiting low frequency band characteristics. Further, the first radiation unit 330 of the internal antenna 300 in accordance with the first embodiment of the present invention is also resonated at a high frequency band shown by reference numeral 110 due to frequency multiplying. However, the bandwidth of the above high frequency is narrow. As described above, it is possible to manufacture an internal antenna exhibiting low frequency band characteristics in accordance with the first embodiment of the present invention.

Figure 5:
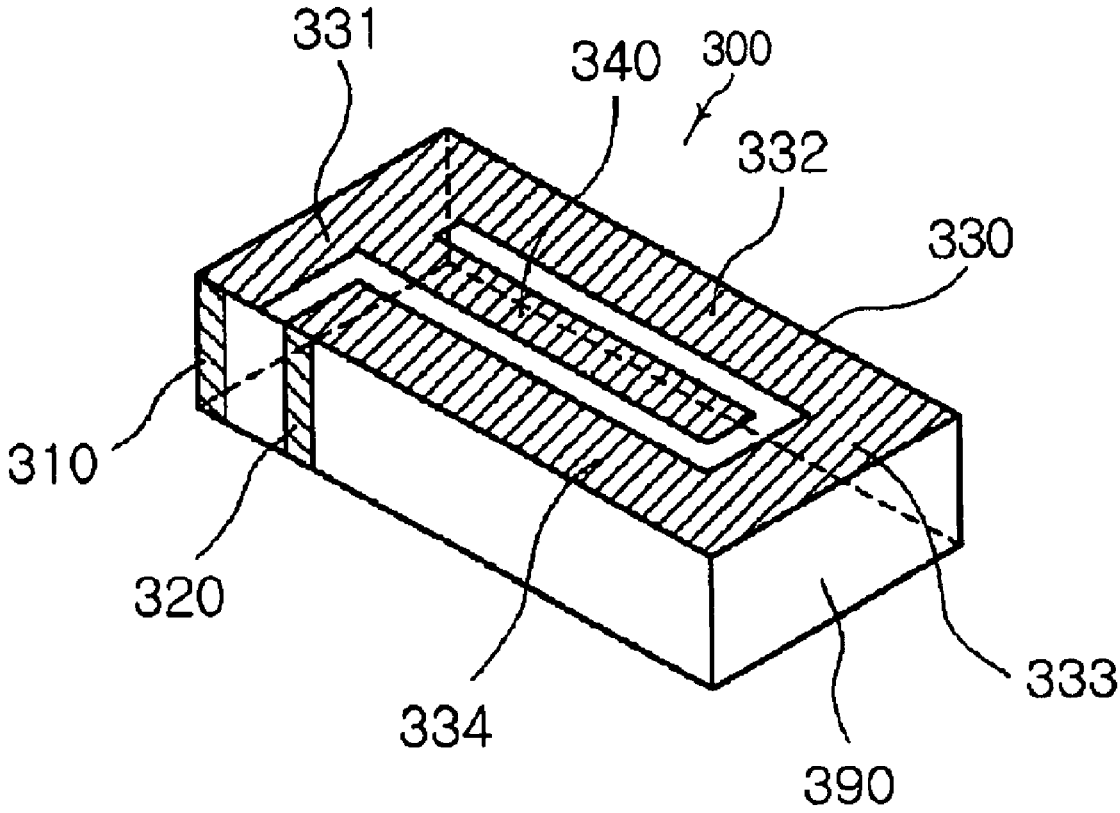
FIG. 5 is a perspective view of an internal antenna in accordance with a second embodiment of the present invention.

FIG. 5 is a perspective view of an internal antenna 300 in accordance with a second embodiment of the present invention.

With reference to FIG. 5, the internal antenna 300 in accordance with the second embodiment of the present invention further comprises a second radiation unit 340 serving to perform radiation at a high frequency band for processing multi-band signals. The second radiation unit 340 is connected to the first radiation unit 330 in a parallel structure on the upper surface of the dielectric support unit 390, and located within the loop-structured first radiation unit 330. Here, the parallel structure means that the second radiation unit 340 is not longitudinally extended from the loop of the first radiation unit 330 but is branched from the side surface of the first radiation unit 330. Preferably, the second radiation unit 340 is formed in a straight band having a designated width, connected to the inner side of the left radiation unit 331 of the first radiation unit 330, and arranged on the upper surface of the support unit 390.

Figure 6:
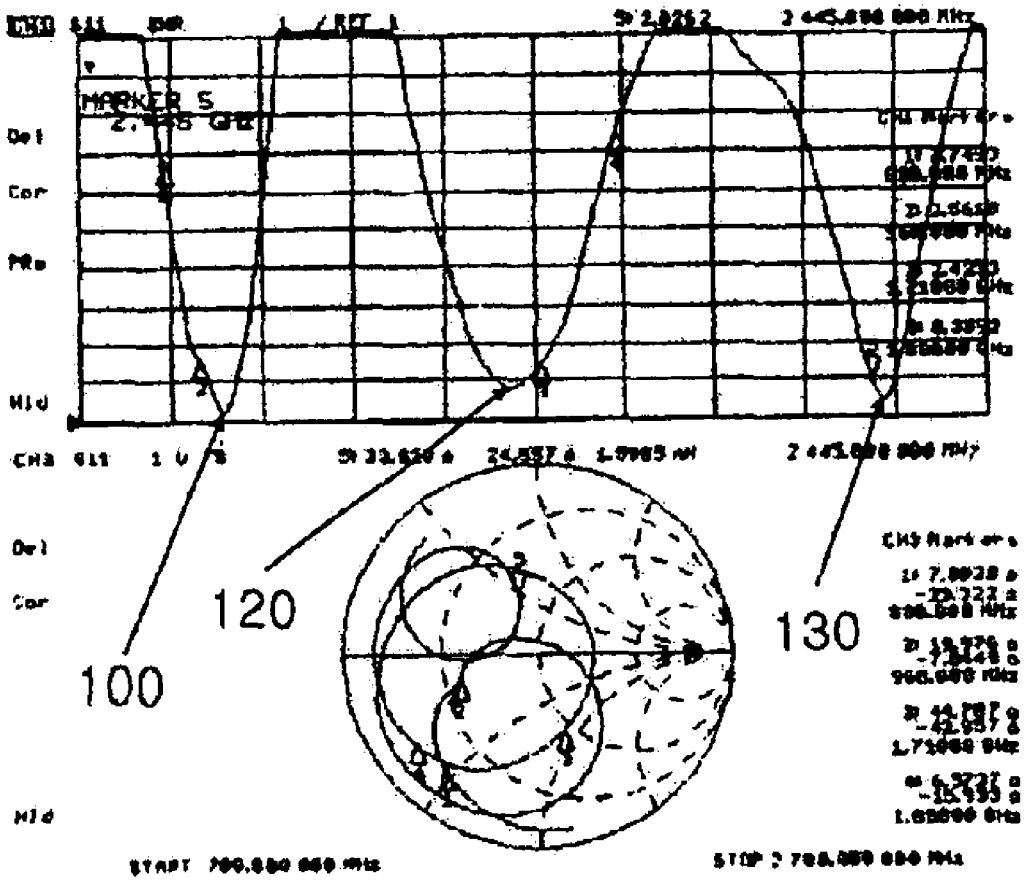
FIG. 6 is a graph illustrating a voltage standing wave ration (VSWR) of the internal antenna in accordance with the second embodiment of the present invention.

FIG. 6 is a graph illustrating a voltage standing wave ratio (VSWR) of the internal antenna 300 in accordance with the second embodiment of the present invention.

With reference to FIG. 6, in the internal antenna 300 in accordance with the second embodiment of the present invention, the first radiation unit 330 is resonated at a low frequency band (900 MHz) shown by the reference numeral 100, and the second radiation unit 340 is resonated at a first high frequency band shown by reference numeral 120, thereby allowing the antenna 300 to exhibit characteristics of a high frequency band having a wide bandwidth. Further, the antenna 300 is also resonated at a second high frequency band, which is higher than the first high frequency band, shown by reference numeral 130. Accordingly, the internal antenna 300 in accordance with the second embodiment can process three frequency bands.

Figure 7:
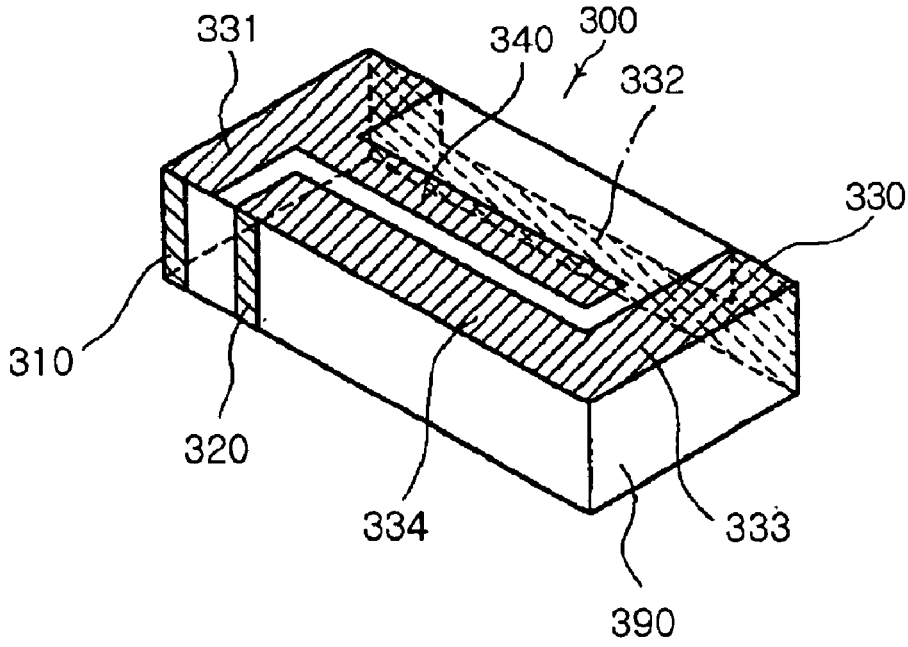
FIG. 7 is a perspective view of an internal antenna in accordance with a third embodiment of the present invention.
Figure 8:
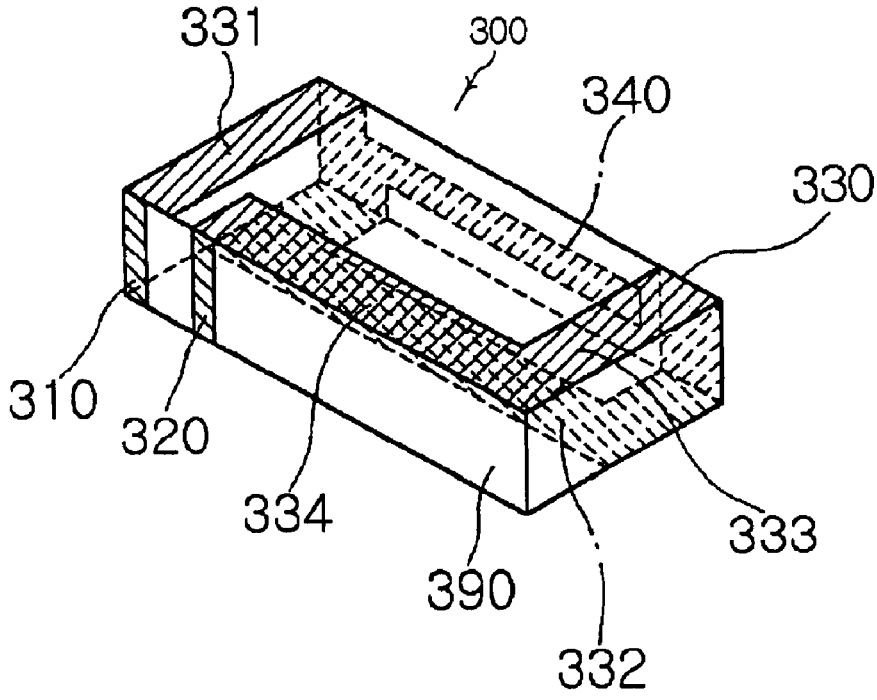
FIG. 8 is a perspective view of an internal antenna in accordance with a fourth embodiment of the present invention.

The internal antenna 300 in accordance with the second embodiment of the present invention may be variably modified as shown in FIGS. 7 and 8.

FIG. 7 is a perspective view of an internal antenna 300 in accordance with a third embodiment of the present invention.

With reference to FIG. 7, the internal antenna 300 in accordance with the third embodiment of the present invention comprises the first radiation unit 330 including the left radiation unit 331, the upper radiation unit 332, the right radiation unit 333, and the lower radiation unit 334. The left radiation unit 331 and the right radiation unit 333 of the first radiation unit 330 are extended such that their extended portions are arranged on the rear surface of the support unit 390. Further, the upper radiation unit 332 of the first radiation unit 330 is located on the rear surface of the support unit 390.

FIG. 8 is a perspective view of an internal antenna 300 in accordance with a fourth embodiment of the present invention.

With reference to FIG. 8, the internal antenna 300 in accordance with the fourth embodiment of the present invention comprises the first radiation unit 330 including the left radiation unit 331, the upper radiation unit 332, the right radiation unit 333, and the lower radiation unit 334. The left radiation unit 331 and the right radiation unit 333 of the first radiation unit 330 are extended such that their extended portions are arranged on the rear and lower surfaces of the support unit 390, and the upper radiation unit 332 of the first radiation unit 330 is located on the lower surface of the support unit 390. Further, the second radiation unit 340 is located on the upper or rear surface of the support unit 390.

Figure 9:
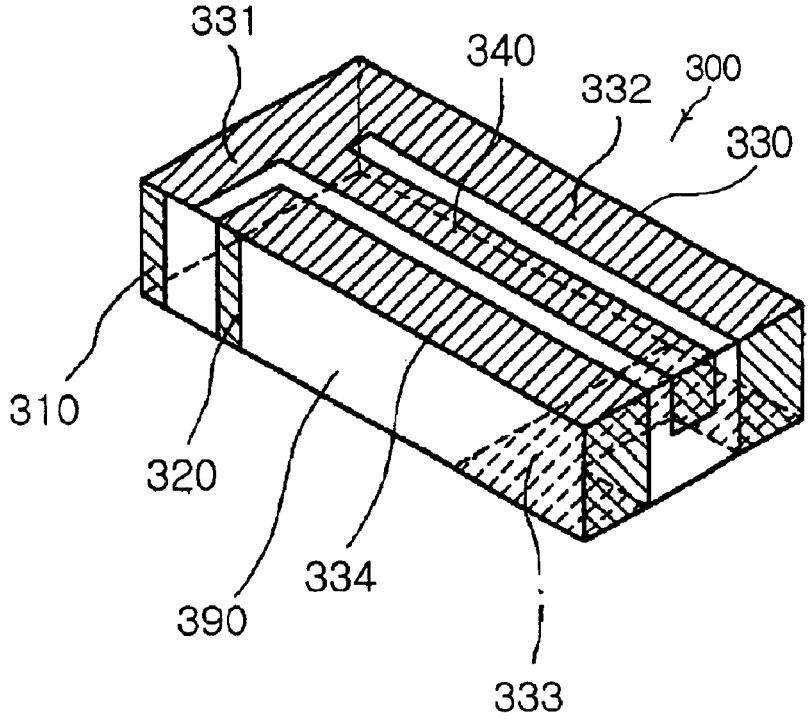
FIG. 9 is a perspective view of an internal antenna in accordance with a fifth embodiment of the present invention.

FIG. 9 is a perspective view of an internal antenna 300 in accordance with a fifth embodiment of the present invention.

With reference to FIG. 9, the internal antenna 300 in accordance with the fifth embodiment of the present invention comprises the first radiation unit 330 including the left radiation unit 331, the upper radiation unit 332, the right radiation unit 333, and the lower radiation unit 334. The upper radiation unit 332 and the lower radiation unit 334 of the first radiation unit 330 are extended such that their extended portions are arranged on the right and lower surfaces of the support unit 390, and the right radiation unit 333 of the first radiation unit 330 is located on the lower surface of the support unit 390. Further, the second radiation unit 340 is located on the upper surface of the support unit 390, or extended to the right side surface of the support unit 390.

Figure 10:
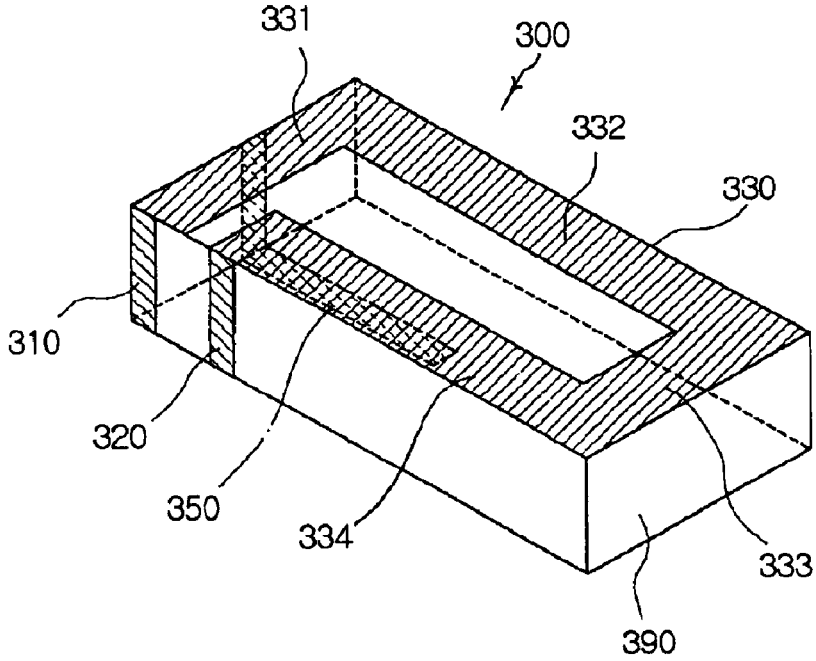
FIG. 10 is a perspective view of an internal antenna in accordance with a sixth embodiment of the present invention.

FIG. 10 is a perspective view of an internal antenna 300 in accordance with a sixth embodiment of the present invention.

With reference to FIG. 10, the internal antenna 300 in accordance with the sixth embodiment of the present invention comprises a third radiation unit 350 serving to perform radiation at a high frequency band, which is connected to the outer side of the loop structure of the first radiation unit 330. More specifically, the third radiation unit 350 is formed in a band shape having a designated width and connected to the first radiation unit 330 in parallel. That is, the third radiation unit 350 is connected to the outer side of the left radiation unit 331 of the first radiation unit 330, and then extended along the left side surface and the lower surface of the support unit 390.

Figure 11:
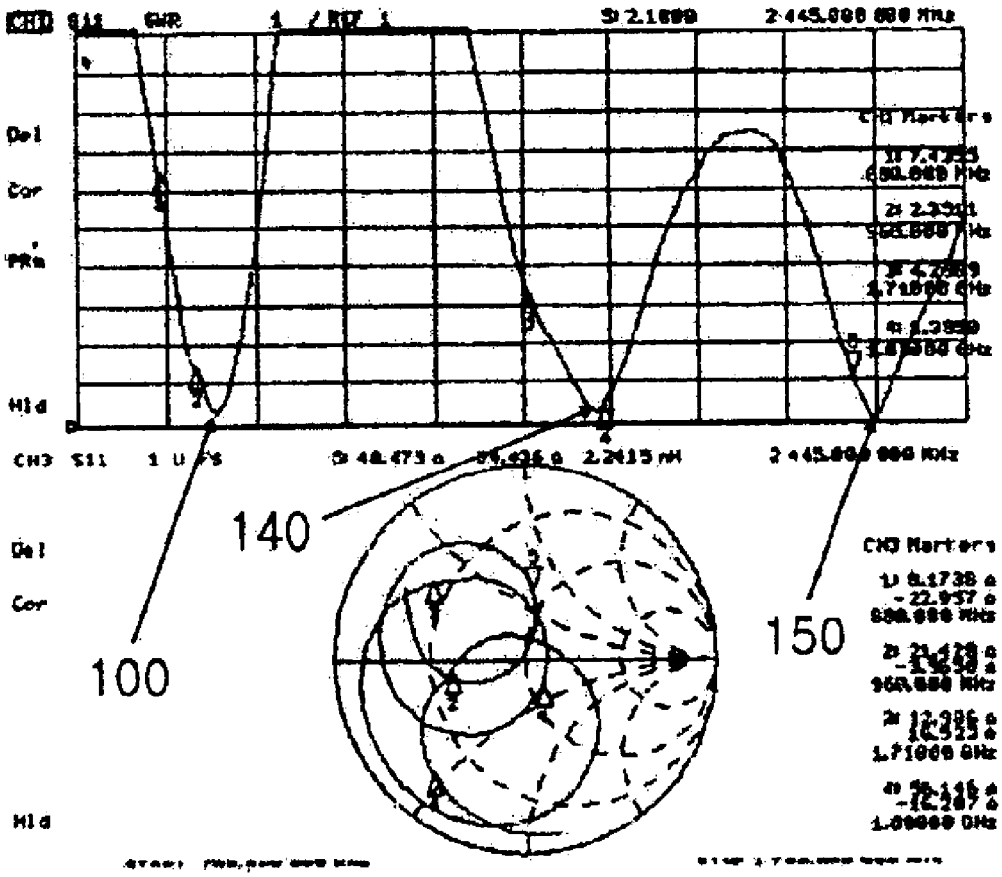
FIG. 11 is a graph illustrating a voltage standing wave ration (VSWR) of the internal antenna in accordance with the sixth embodiment of the present invention.

FIG. 11 is a graph illustrating a voltage standing wave ration (VSWR) of the internal antenna 300 in accordance with the sixth embodiment of the present invention.

With reference to FIG. 11, in the internal antenna 300 in accordance with the sixth embodiment of the present invention, the first radiation unit 330 is resonated at a low frequency band (900 MHz) shown by the reference numeral 100, and the third radiation unit 350 is resonated at two high frequency bands shown by reference numerals 140 and 150, thereby allowing the internal antenna 300 to exhibit high frequency band characteristics. Accordingly, the internal antenna 300 in accordance with the sixth embodiment of the present invention exhibits a multi-band property.

Figure 12:
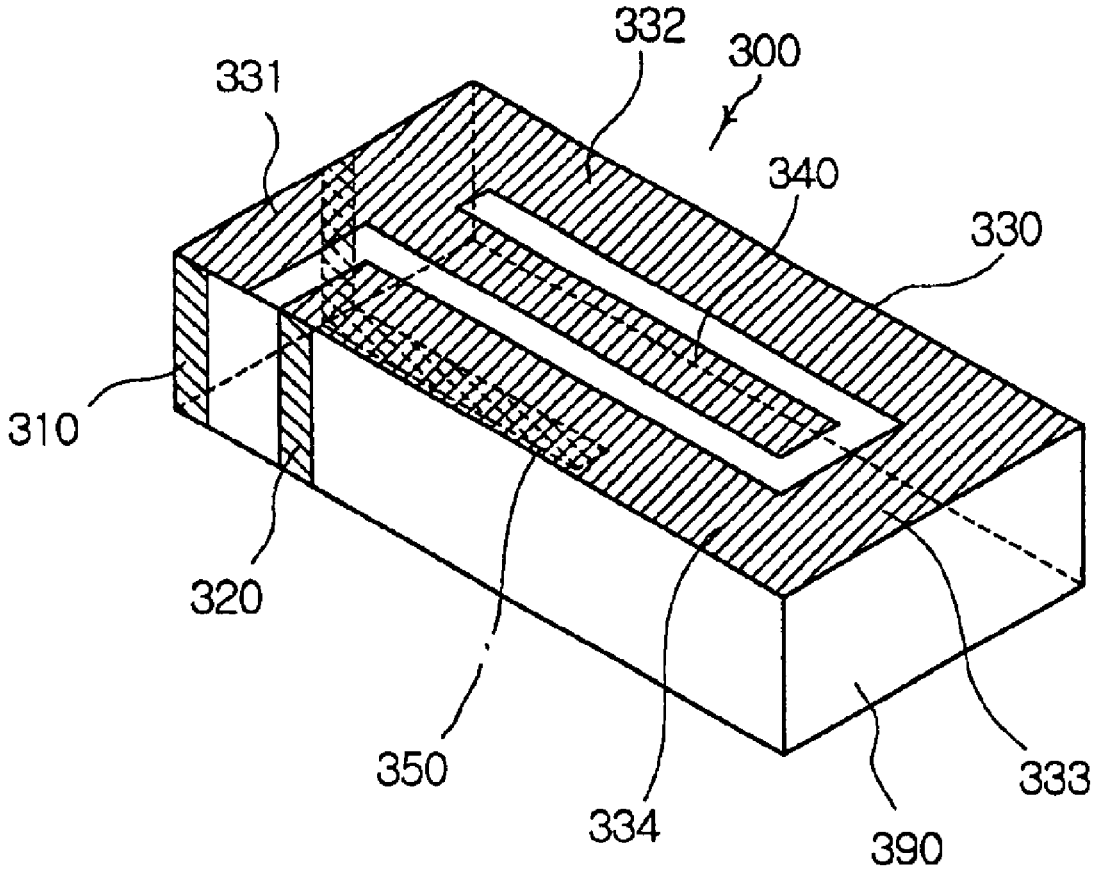
FIG. 12 is a perspective view of an internal antenna in accordance with a seventh embodiment of the present invention.

FIG. 12 is a perspective view of an internal antenna 300 in accordance with a seventh embodiment of the present invention.

With reference to FIG. 12, the internal antenna 300 in accordance with the seventh embodiment of the present invention comprises the above-described first, second and third radiation units 330, 340 and 350. Here, the first radiation unit 330 is arranged along the edge of the upper surface of the support unit 390. The second radiation unit 340 is connected to the inner side of the left radiation unit 331 and arranged on the upper surface of the support unit 390. Further, the third radiation unit 350 is connected to the outer side of the left radiation unit 331 and arranged along the left side and lower surfaces of the support unit 390.

Figure 13:
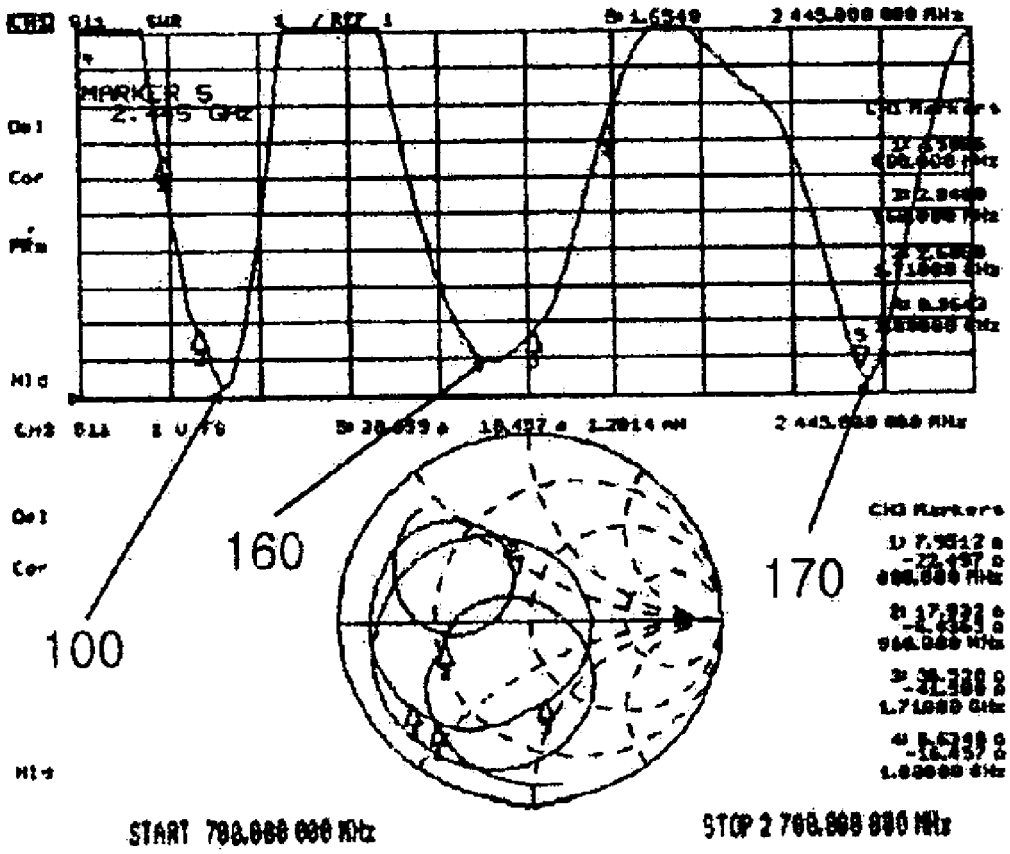
FIG. 13 is a graph illustrating a voltage standing wave ration (VSWR) of the internal antenna in accordance with the seventh embodiment of the present invention.

FIG. 13 is a graph illustrating a voltage standing wave ration (VSWR) of the internal antenna 300 in accordance with the seventh embodiment of the present invention.

With reference to FIG. 13, in the internal antenna 300 in accordance with the seventh embodiment of the present invention, the first radiation unit 330 is resonated at a low frequency band (900 MHz) shown by the reference numeral 100, and the second and third radiation units 340 and 350 are resonated at two high frequency bands shown by reference numerals 160 and 170. As shown in FIG. 13, the high frequency band 160 is considerably wide. The internal antenna 300 in accordance with the seventh embodiment comprises the second and third radiation units 340 and 350, thereby being improved in terms of high frequency band characteristics.

Figure 14:
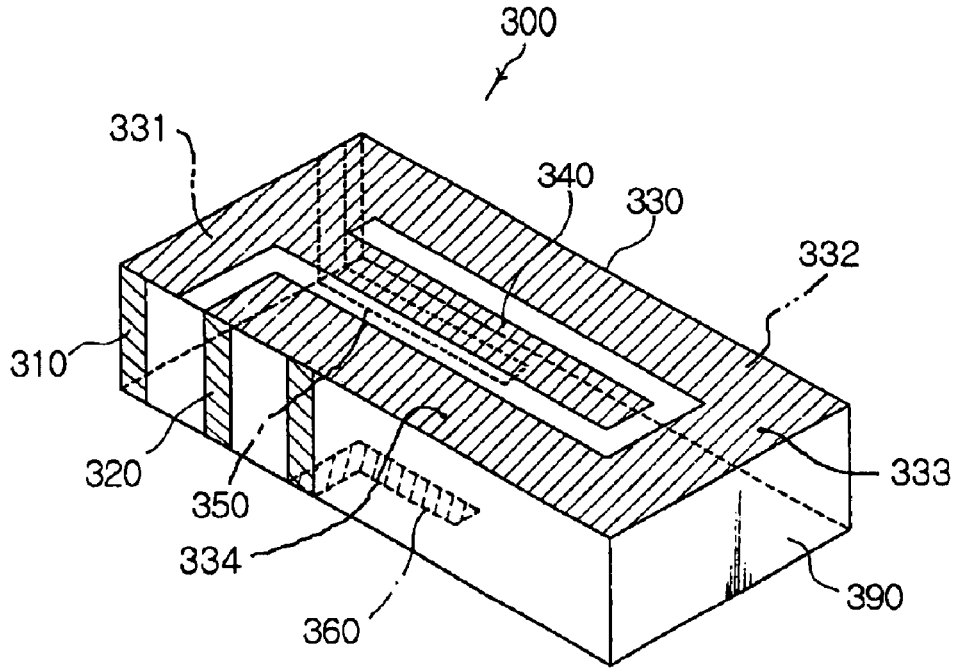
FIG. 14 is a perspective view of an internal antenna in accordance with an eighth embodiment of the present invention.

FIG. 14 is a perspective view of an internal antenna 300 in accordance with an eighth embodiment of the present invention.

With reference to FIG. 14, the internal antenna 300 in accordance with the eighth embodiment of the present invention further comprises a frequency adjustment unit 360. The frequency adjustment unit 360 is formed in a band shape having a designated width. The frequency adjustment unit 360 is connected to the outer side of the lower radiation unit 334 of the first radiation unit 330, and arranged along the front or lower surface of the support unit 390. Preferably, the frequency adjustment unit 360 is bent at a designated position of the lower surface of the support unit 390 toward the right side. The frequency adjustment unit 360 is connected to the first radiation unit 30 in parallel, and serves to adjust the frequency to be processed by the antenna 300, thereby controlling impedance matching.

Figure 15:
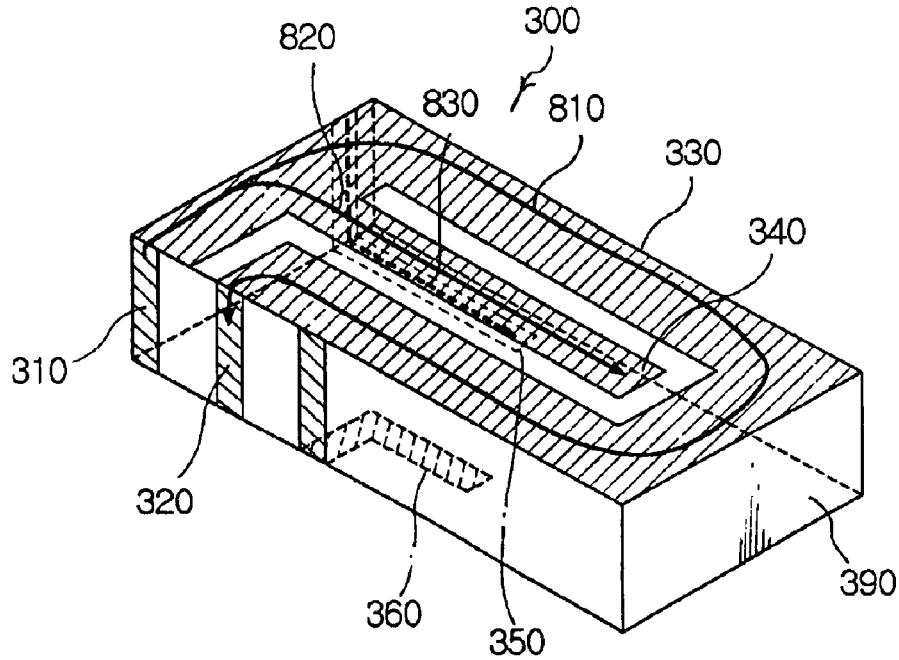
FIG. 15 is a perspective view illustrating a current path in the internal antenna in accordance with the eighth embodiment of the present invention.

FIG. 15 is a perspective view illustrating a current path in the internal antenna 300 in accordance with the eighth embodiment of the present invention.

As shown in FIG. 15, currents 810, 820 and 830 are introduced into the first, second and third radiation units 330, 340 and 350 through the power feed pin 310. The first radiation unit 330 radiates a radio wave of a low frequency signal by means of the current 810 introduced into the first radiation unit 330. Further, the second and third radiation units 320 and 330 radiate radio waves of high frequency signals by means of the currents 820 and 830 introduced into the second and third radiation units 340 and 350, respectively.

In accordance with the above-described embodiments of the present invention, it is possible to manufacture a small-sized antenna, which has a loop structure and comprises a plurality of radiation units having modified shapes for respectively radiating waves at different frequency bands. Further, it is possible to reduce the effect of the human body on the internal antenna (for example, distortion or deterioration of characteristics of the internal antenna generated in case that a user grips a portion of a mobile communication terminal where the internal antenna is installed, or holds this portion to his/her ear).

Further, the internal antenna of the present invention allows a mobile communication terminal employing the antenna to be miniaturized and aesthetically designed. Particularly, the internal antenna in accordance with the embodiments of the present invention is desirably employed in a folder type mobile communication terminal. Since the folder type mobile communication terminal has a small size, it is difficult to install the conventional F-type antenna requiring a large storage space in the folder type mobile communication terminal. Moreover, in case that the conventional F-type antenna is installed in the folder type mobile communication terminal, when the folder is opened from and closed into a main body of the terminal, a ground structure of the conventional F-type antenna in the terminal is changed according to the variation of the position of the folder on the main body of the terminal, thereby frequently generating mute in conversation by the terminal. However, by installing the loop-type antenna in accordance with the embodiments of the present invention in the folder-type mobile communication terminal, it is possible to process signals of multiple frequency band at a small space and to reduce the influence of a user's body and a position of the folder of the terminal.

In the internal antenna 300 in accordance with the embodiments of the present invention, the first, second and third radiation units 330, 340 and 350, the power feed unit 310, the ground unit 320 and the frequency adjustment unit 360 are made of an electrically conductive material by various methods such as sheet metal working, paste working, plating, etc. The dielectric support unit 390 for supporting the antenna 300 is made of one of various dielectric materials. The dielectric support unit 390 made of dielectric ceramic or polymer has various shapes including hexahedral and cylindrical shapes.

As apparent from the above description, the present invention provides an internal antenna for a mobile communication terminal, which reduces distortion and deterioration in antenna characteristics due to influence of a user's body.

Particularly, the internal antenna of the present invention reduces the influence of a user's body and a position of a folder in a folder type mobile communication terminal, thereby being remarkably improved in terms of communicating performance.

Further, the internal antenna of the present invention can be produced in a small-size, thereby reducing a size of a mobile communication terminal employing the internal antenna and improving an aesthetic appearance of the mobile communication terminal.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An internal antenna for a mobile communication terminal, said antenna comprising:

a dielectric support unit for supporting the antenna;

a power feed unit for feeding power to the antenna;

a ground unit for grounding the antenna;

a first radiation unit formed in a band shape with a designated width, having one end connected to the power feed unit and another end connected to the ground unit arranged along an edge of an upper surface of the dielectric support unit so as to form a loop-shaped current path, and radiating at a designated low frequency band when a current is introduced to the power feed unit; and a second radiation unit formed in a band shape with a designated width, connected to an inner side of a left radiation unit of the first radiation unit, arranged on the upper surface of the dielectric support unit, and radiating at a designated high frequency band when the current is introduced to the power feed unit.

2. The internal antenna as set forth in claim 1, wherein the power feed unit or the ground unit is arranged at an end of a side surface of the dielectric support unit.

3. The internal antenna as set forth in claim 1, wherein the dielectric support unit ham an approximately hexahedral shape, and the first radiation unit is divided into the left radiation unit, an upper radiation unit, a right radiation unit and a lower radiation unit according to their positions arranged on the upper surface of the dielectric support unit.

4. The internal antenna as set forth in claim 1, wherein the left, upper and right radiation units of the first radiation unit are extended such that their extended portions are arranged on a rear surface of the dielectric support unit.

5. The internal antenna as set forth in claim 1, wherein the left, upper and right radiation units of the first radiation unit are extended such that their extended portions are arranged on rear and lower surfaces of the dielectric support unit.

6. The internal antenna as set forth in claim 1, wherein the upper, right and lower radiation units of the first radiation unit are extended such that their extended portions are arranged on a right side surface or a lower surface of the dielectric support unit.

7. The internal antenna as set forth in claim 6, wherein the second radiation unit is extended such that its extended portion is arranged on the right side surface of the dielectric support unit.

8. The internal antenna as set forth in claim 1, wherein the mobile communication terminal is a folder-type terminal.

9. The internal antenna as set forth in claim 1, further comprising a third radiation unit formed in a band shape with a designated width, connected to an outer side of the left radiation unit of the first radiation unit, arranged on a left side surface or a lower surface of the dielectric support unit, and radiating at a designated high frequency band when the current is introduced to the power feed unit.

10. The internal antenna as set forth in claim 9, further comprising a frequency adjustment unit formed in a band shape with a designated width, and connected to an outer side of the first radiation unit for adjusting a frequency to be processed by the antenna so as to control impedance matching.

11. The internal antenna as set forth in claim 10, wherein the frequency adjustment unit is connected to an outer side of a lower radiation unit of the first radiation unit and arranged along a front surface or the lower surface of the dielectric support unit.

12. The internal antenna as set forth in claim 11, wherein the frequency adjustment unit is bent at a designated position of the lower surface of the dielectric support unit toward a right side surface of the dielectric support unit.

13. An internal antenna for a mobile communication terminal, said antenna comprising:

a dielectric support unit far supporting the antenna;

a power feed unit for feeding power to the antenna;

a ground unit for grounding the antenna;

a first radiation unit formed in a band shape with a designated width, having one end connected to the power feed unit and another end connected to the ground unit, arranged along an edge of an under surface of the dielectric support unit so as to form a loop-shared current path, and radiating at a designated low frequency band when a current is introduced to the power feed unit; and a further radiation unit formed in a band shape with a designated width, connected to an outer side of a left radiation unit of the first radiation unit, arranged on a left side surface or a lower surface of the dielectric support unit, and radiating at a designated high frequency band when the current is introduced to the power feed unit.

14. The internal antenna as set forth in claim 13, further comprising a frequency adjustment unit formed in a band shape with a designated width, and connected to an outer side of the first radiation unit for adjusting a frequency to be processed by the antenna so as to control impedance matching.

15. The internal antenna as set forth in claim 14, wherein the frequency adjustment unit is connected to an outer side of a lower radiation unit of the first radiation unit and arranged along a front surface or the lower surface of the dielectric support unit.

16. The internal antenna as set forth in claim 15, wherein the frequency adjustment unit is bent at a designated position of the lower surface of the dielectric support unit toward a right side surface of the dielectric support unit.

17. An internal antenna for a communication terminal, said antenna comprising:

a dielectric support;

a power terminal formed on the dielectric support for providing power to the antenna;

a ground terminal formed on the dielectric support for grounding the antenna;

a first, elongated radiation element resonating at a first frequency band when the antenna is powered via said power terminal, wherein said first radiation element is formed on said dielectric support and has opposite ends connected to the power and ground terminals to form a current path between said terminals, said current path having a shape of an open loop; and a second, elongated radiation element resonating at a second frequency band higher than the first frequency band when the antenna is powered via said power terminal, wherein said second radiation element is a branch connected to a middle section of said open loop of said first radiation element.

18. The internal antenna as set forth in claim 17, wherein the dielectric support has an approximately hexahedral shape with upper, lower, right side, left side, front and rear faces;

said open loop of said first radiation element and said second radiation element are completely positioned on the upper face of said dielectric support; and said second radiation element extends inwardly of said open loop.

19. The internal antenna as set forth in claim 17, wherein the dielectric support has an approximately hexahedral shape with upper, lower, right side, left side, front and rear surfaces;

said open loop of said first radiation element is formed on at least two adjacent ones of said faces; and said second radiation element is farmed on at least one of said at least two adjacent faces.

20. The internal antenna as set forth in claim 17, wherein the dielectric support has an approximately hexahedral shape with upper, lower, right side, left side, front and rear surfaces; and said open loop of said first radiation element and said second radiation element are not coexistent on any of said faces.

21. The internal antenna as set forth in claim 20, further comprising an elongated, frequency adjustment element connected to said first radiation element for adjusting a frequency to be processed by the antenna so as to control impedance matching.

* * * * *